United States Patent [19]

Burson

[11] Patent Number: 4,587,942

[45] Date of Patent: May 13, 1986

[54] BREAKERLESS IGNITION SYSTEM AND METHOD OF MANUFACTURE THEREOF

[75] Inventor: Bob O. Burson, East Longmeadow, Mass.

[73] Assignee: R. E. Phelon Company, East Longmeadow, Mass.

[21] Appl. No.: 549,089

[22] Filed: Nov. 7, 1983

[51] Int. Cl.[4] ..... F02P 3/06

[52] U.S. Cl. ..... 123/599; 123/149 D; 123/647

[58] Field of Search ..... 123/149 C, 149 D, , 123/599, 600, 601, 602, 651, 647

[56] References Cited

U.S. PATENT DOCUMENTS

| | | | |
|---|---|---|---|
| 3,599,615 | 8/1971 | Foreman et al. | 123/602 X |
| 3,667,441 | 6/1972 | Cavil | 123/601 |
| 4,188,930 | 2/1980 | Santi | 123/149 C X |
| 4,270,509 | 6/1981 | Tharman | 123/149 C X |
| 4,282,839 | 8/1981 | Newberry et al. | 123/602 X |
| 4,288,834 | 9/1981 | Burson | 123/601 X |
| 4,375,794 | 3/1983 | Wasmer | 123/149 C |

*Primary Examiner*—Tony M. Argenbright

*Attorney, Agent, or Firm*—Chapin, Neal & Dempsey

[57] ABSTRACT

The disclosure describes an ignition coil module for internal combustion engines and method of manufacture thereof. The module is mounted on a ferromagnetic core having a plurality of discrete leg portions with mating cross-bar portions. The module includes an ignition coil encapsulated within a cup-shaped plastic housing which is disposed about the mating portions of the core. A separate trigger coil is also encapsulated within the housing and a separate core pin is axially fitted within the trigger coil. The core pin includes a shank portion and an enlarged pole portion disposed externally of said housing adjacent one of the core legs. The outer ends of the core legs and the pole portion of the core pin, which provides a separate flux path, are disposed approximately on the same circumference adjacent to the permanent magnets carried by a rotor used in conjunction with the ignition coil. The core pin is asymmetrical with its pole portion offset toward the adjacent core leg. In an alternative embodiment, the pole portion is disposed at an obtuse angle to the shank portion of the pin.

8 Claims, 6 Drawing Figures

Fig. 1.
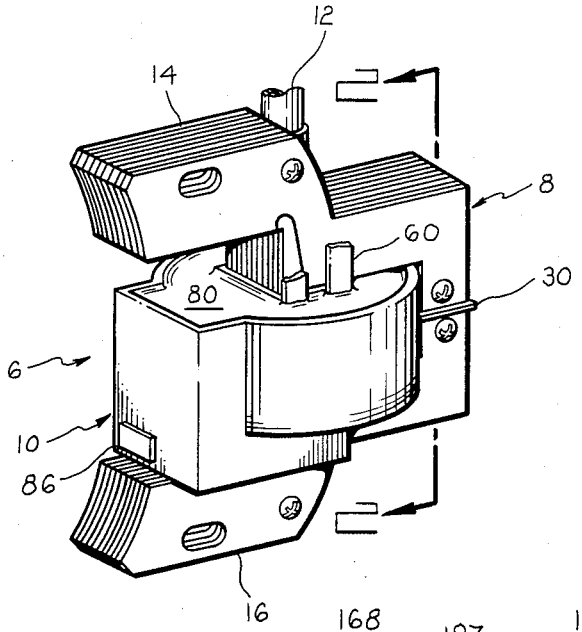
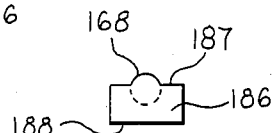
Fig. 4.
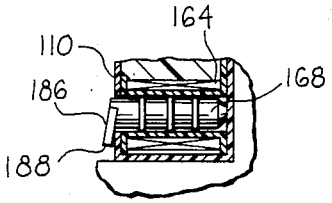
Fig. 3.
Fig. 2.
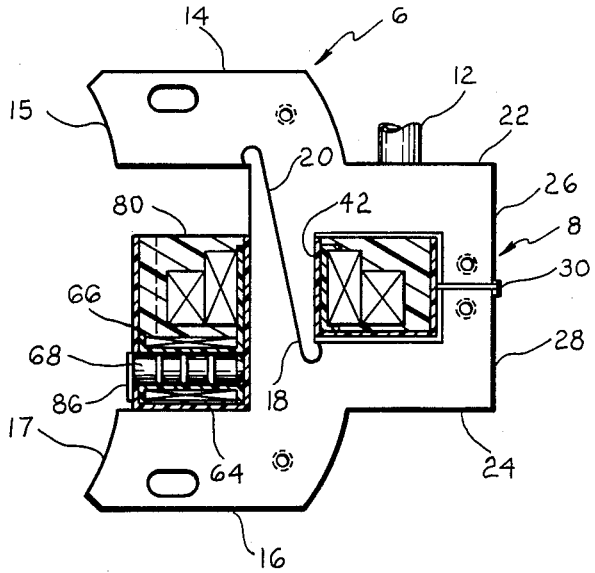

BREAKERLESS IGNITION SYSTEM AND METHOD OF MANUFACTURE THEREOF

BACKGROUND OF THE INVENTION

This invention relates to breakerless ignition systems for use with spark-ignited internal combustion engines and deals more particularly with the construction and method of manufacture of the ignition coil module for use with an inductive type system.

The ignition system of this invention is particularly adapted for use in conjunction with small single cylinder internal combustion engines of the type commonly used for powering lawnmowers, snowblowers and the like.

Because of the highly competitive nature of the small engine market it is significant in carrying out this invention that the coil module be of unitary construction with a minimum number of parts so as to reduce the manufacturing costs and simplify its construction.

The prior art patent to Piteo U.S. Pat. No. 3,484,677 granted on Dec. 16, 1969, discloses a breakerless magneto ignition system of the inductive type in which the ignition coil and a trigger coil are both disposed within a unitary housing mounted on one leg of a ferromagnetic core. The patent to Burson U.S. Pat. No. 4,037,201 dated July 19, 1977, discloses a unitary coil module composed of a unitary plastic housing also disposed on one leg of a laminated core. While in both of these prior patents assigned to the R. E. Phelon Company, also assignee of the present application, the coils of the ignition system are all disposed within the same housing, the coils are all disposed on the same core leg. As a result, the coil constructions shown in both of these prior patents do not lend themselves to an ignition system utilizing a separate trigger coil which is not part of the main flux carrying core of the ignition system.

Accordingly, it is the principal object of this invention to provide an improved coil module for an inductive ignition system of simple and economical construction in which a separate trigger coil and its core are disposed within the same housing as the ignition transformer coil, but are axially spaced from the ignition coil.

It is another object of this invention to provide a coil module of the above type in which the trigger core includes a shank portion and an asymmetrical pole piece disposed externally of the housing for improved performance.

It is yet another object of this invention to provide a simplified method of fabricating a coil module of the above type. The above and other objects and advantages of this invention will be more readily apparent from the following description read together with the accompanying drawings in which:

FIG. 1 is a perspective view showing the module disposed on a laminated core;

FIG. 2 is a cross-sectional view taken along line 2—2 of FIG. 1;

FIG. 3 is a partial elevational view showing an alternate core pin construction for use in practicing this invention;

FIG. 4 is a top plan view of the core pin shown in FIG. 5;

Figure 5:
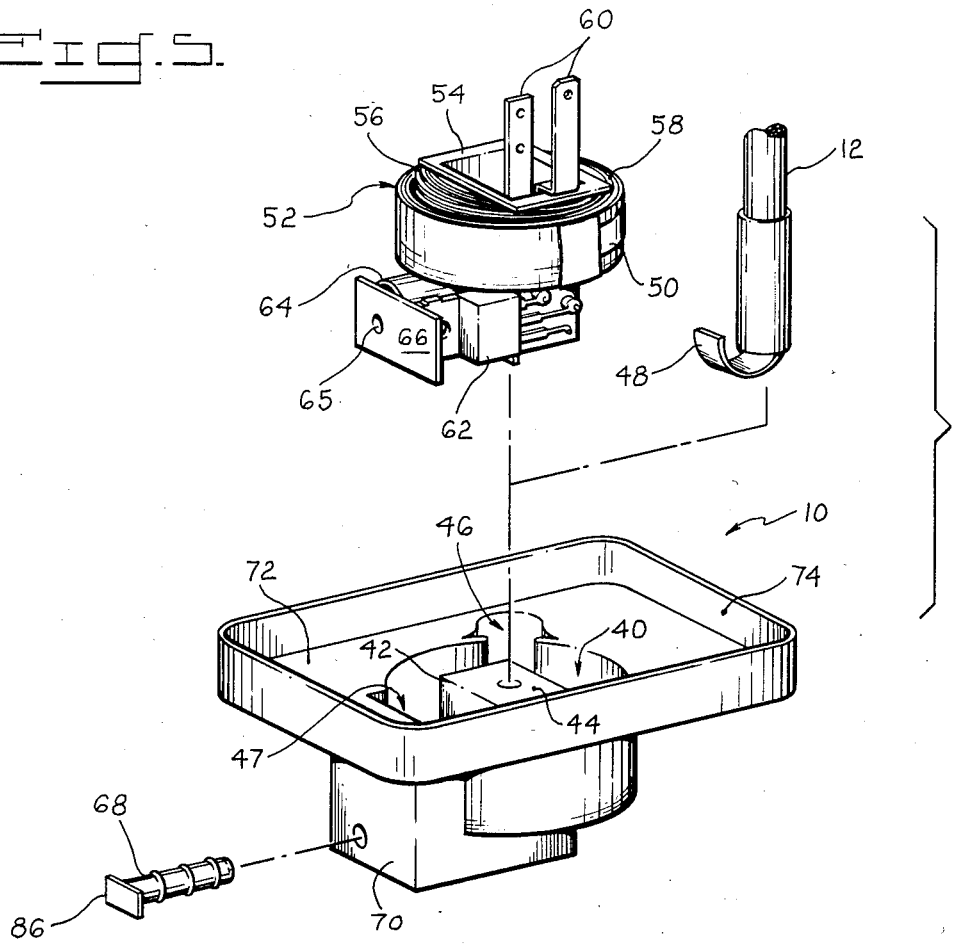
FIG. 5 is an exploded perspective view of an ignition coil module and core of the type embodying this invention.

Referring in detail to the drawings, a breakerless ignition system is shown generally at 6 in FIG. 1. The system comprises a laminated ferromagnetic core 8 and a unitary coil housing 10. A high tension lead wire or cable 12 extends from the coil module for connection to a spark-gap device in an internal combustion engine, not shown.

The coil/core group is adapted to generate repetitive ignition pulses in response to rotation of the poles of a permanent magnet means carried by a rotor, such as a flywheel. The magnet poles (not shown) are rotated in a circular path in close proximity to the outer end faces of the leg portions of the core 8.

The core 8 comprises two separate or discrete portions 14 and 16. The two portions each include a radially extending leg portion having an arcuate outer end surface 15 and 17 respectively and a tapered transverse portion 18 and 20. Each core portion also includes an additional radially extending portion 22 and 24 and an outer cross-bar portion 26 and 28, which are separated by a non-magnetic spacer or disc 30 thereby providing a flux limiting path. The tapered portions of the core are oppositely inclined at the same angle so that their tapered surfaces can be mated in abutting surface-to-surface engagement when the two portions are assembled as shown in FIGS. 1 and 2. The two portions of the core, each form approximately one-half of the core and when their tapered surfaces are abutted, a complete flux carrying core is provided. The end of each tapered cross-bar portion includes a rounded end or radius portion fitted into a correspondingly shaped recess in the opposite portion of the other core portion.

Figure 6:
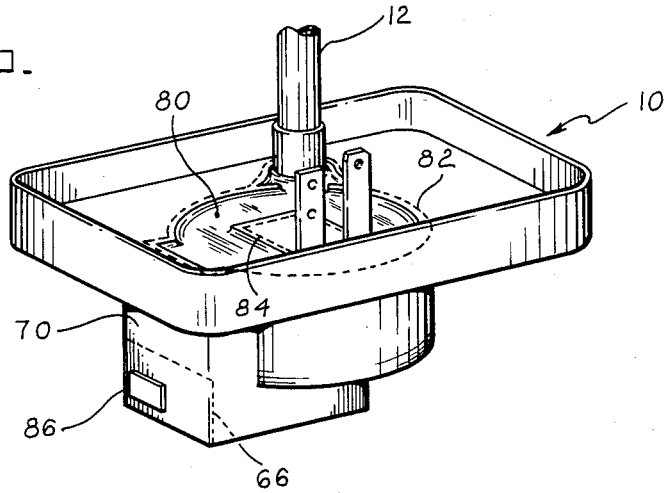
FIG. 6 is a perspective view showing the ignition system module of FIG. 5 in assembled relation.

The coil housing 10 is disposed about the transverse or cross-bar portion of the core which is formed by the two tapered sections 18 and 20. As best illustrated in FIGS. 5 and 6, the housing which is preferable of integral construction fabricated in a single cavity mold includes a cylindrical cup portion 40 and includes at the center thereof, an upstanding chimney 42 of rectangular cross-section. The end of the chimney includes a removable end wall 44. The coil housing 10 also includes a semi-cylindrical cavity 46 which opens inwardly into the cylindrical cavity 40 of the housing. In addition, a generally rectangular cavity 47 also communicates with the cylindrical cavity. Cavity 46 is adapted to receive the inner end of high tension cable 12 which includes a flexible leaf spring contact 48 provided to engage a foil terminal strip 50 on the outer periphery of the ignition coil 52. Surrounding the central cavity portion of the housing 10 is a horizontal flange 72 and an upwardly extending rim 74. The sidewall portions of the housing have a slight taper of draught for easy removal from the single cavity mold.

The ignition coil 52 comprises a tubular rectangular bobbin 54 open at both ends. A primary coil winding 56 and secondary coil winding 58 are coaxially disposed about the plastic bobbin 54 and a pair of ground terminals 60 extend from the grounded end of each winding.

An electronic package 62 which includes an electronic switching component, such as a Darlington pair commonly used in inductive ignition systems is disposed on a mounting panel which extends from the lower end of the bobbin 54. A trigger coil 64, also supported on the depending mounting panel, provides a trigger signal to cause the electronic switch to become nonconductive, whereby the current through the primary coil collapses and induces an ignition pulse in the secondary coil 52.

The trigger coil 64 is wound coaxially about a small plastic bobbin of cylindrical cross-section which may be either tubular or solid in cross-section. In the illustrated embodiment of FIG. 5, the bobbin includes a small bore 65 and at its outer end the bobbin includes a flange 66 disposed transversely to the axis of the trigger coil. This flange serves as an alignment member dimensioned for a close sliding fit within the cavity 47 and against the outer wall 70 of the rectangular portion of the housing 10. The flange 66 accurately aligns the trigger coil 64 to a predetermined postion vertically and horizontally within the housing 10 for subsequent insertion of a asymmetrical iron pin or core 68 coaxially within the trigger coil 64.

As best illustrated in FIG. 5, the core 68 comprises a shank portion of cylindrical cross-section which is preferably knurled or ribbed, as illustrated, and an enlarged pole portion 86 adapted to provide a low reluctance flux path for the flux of the permanent magnet(s) carried by a rotor. As best illustrated in FIG. 2, the pole piece 86 is of rectangular shape with its geometic center offset from the axis of the shank portion of the core toward adjacent leg 16 of the core 6. The shank of the core may be fitted into the axial bore of the trigger coil 64 either before or after potting the coil section of the system, although subsequent insertion is considered preferential from the standpoint of avoiding leakage of the potting liquid.

As best shown in FIGS. 5 and 6, the coil section fits into the cavity 40 with the bobbin 54 telescopically disposed on the upstanding chimney 42. The trigger coil 64 and electronic component module 62 fit into the rectangular cavity 47 and the high tension cable 12 is disposed in the semi-cylindrical cavity 46. After assembly of the several components, a suitable potting compound 80, such as an epoxy resin in liquid form is poured into the housing to encapsulate all the coils and electronic components with an electrical insulating material.

After the potting compound has hardened or solidified, the flange 72 and rim portion of the housing 10 may be cut away in a cutting or stamping operation. To facilitate this operation, a weakened score line 82 is disposed about the circumference of cavities 40, 46, and 47 and the end wall 44 of the chimney 42 may also be removed in the same stamping operation. Another score line 84 may also be provided to assist in this operation. Upon removal of the end wall 42, the chimney 42 has an opening therethrough at its upper end which is adapted to receive the crossbar portion of the core 8, as illustrated in FIG. 2.

If the core pin has not been previously inserted into the trigger coil, after potting the coils, the housing may be placed in a suitable fixture and a hole is drilled through the wall 70 of the housing point in alignment with the axis of the trigger coil bobbin which flange 66 orients at a predetermined fixed location. The bobbin of the trigger coil may either be tubular or solid in cross-section prior to the drilling operation. In any event, after the drilling operation has been completed, the axis of the trigger coil will have a bore adapted to receive and retain therein the shank portion of the core pin 68. The shank of the core pin is driven into the bore 65 until the inner surface of the pole piece 86 contacts the outer surface of the housing 10, as shown in FIG. 6. The diameter of the core pin and its knurled outer surface are such that a force fit results and the core will be securely and permanently seated within the trigger coil without the use of any fasteners or holding members. The core pin is inserted and positioned so that its offset pole portion is located adjacent the inner edge of adjacent core leg 16 (FIG. 2).

In an alternative method of fabricating the ignition coil module, before potting, a hole may be provided through the wall of the housing in registration with the axis of the trigger coil 66. The shank of the core pin may then be fitted through the wall of housing 10 and into the bore of the trigger coil. Thereafter, the housing may be potted to encapsulate the ignition coils and trigger coil as described above.

In FIG. 3 is shown an alternative core pin construction having a cylindrical shank portion 168 fitted into the axial bore of a trigger coil 164. The pin includes a generally rectangular pole piece or head portion 186 disposed externally of the coil housing 110. The pole piece extends at an obtuse angle relative to the axis of shank portion 168 of the core pin so that it will be oriented in closer proximity to the arc of rotation of the magnetic poles of the rotor. Moreover, the configuration of the pole piece 186 is preferably asymmetrical or offset from the core pin axis as illustrated in FIG. 4. The inner edge 187 of the pole piece lies in the same plane as the axis of the shank 168, while its outer edge 188 is offset a substantial distance therefrom. In this embodiment, the geometric center of pole piece 186 is disposed in closer proximity to the adjacent core leg, such as 16 in FIG. 1, of the flux carrying core. As a result of its oblique angular orientation and its asymmetrical configuration, close magnetic coupling with the rotating magnets is achieved while at the same time the retard angle is minimized at higher engine speeds.

After the coil module is fabricated as described above, it can be readily assembled with the two core portions 14 and 16 of the core 8. The two tapered crossbar portions 18 and 20 of the core are fitted in opposite directions through the open ended chimney 42 and each of their rounded outer ends is fitted into a correspondingly shaped recess in the opposite core member, as shown in FIG. 2. The ground terminals 60 are then fastened by welding to the side surfaces of the core as shown in FIG. 1.

As illustrated in FIG. 1, the coil module 6 which includes transformer coil, trigger coil and electronic unit is wholly self-contained within a unitary potted housing. Nevertheless, the pole piece 86 of FIG. 1 and 186 of FIG. 4 are disposed externally of the flat or planar housing wall 70 and the outer surface of the poles will be positioned adjacent the circumferential path defined by the arcuate end faces 15 and 17 of the core 8. It will be realized, however, that the outwardly angled pole piece 186 of FIGS. 3 and 4 will be disposed in closer proximity to the rotating magnet means for maximum flux coupling. As a result of the close proximity of the pole pieces to the magnet means carried by the rotor, a substantial amount of flux is picked up by the pole pieces as the magnet means rotate past the core and a relatively strong trigger signal is induced in the trigger coil.

The coil construction and its method of manufacture embodying this invention, provide a highly effective inductive ignition system which is relatively inexpensive and simple to fabricate. In addition, maximum efficiency of the trigger coil is obtained by the partial external disposition of the pole portion of its core externally of the trigger coil housing.

Having thus described this invention, what is claimed is:

1. Coil module for a breakerless ignition system having a first core with at least two-leg portions for carrying flux generated by rotatable magnet means comprising a unitary housing with an ignition transformer coil having a primary winding and a secondary winding coaxially disposed on said first core and within said housing and a trigger coil also disposed within said housing adjacent one of said leg portions and encapsulated within a potting compound disposed therein, said trigger coil being disposed coaxially about a second core which includes a shank portion within said housing and an outer pole portion disposed externally of said housing, the longitudinal axis of the shank portion of said trigger coil being offset a substantial distance from the axis from said transformer coil.

2. Coil module for a breakerless ignition system as set forth in claim 1 in which said outer pole portion is an enlarged rectangular flange disposed in abutting relation with the outer surface of the coil housing.

3. Coil module for a breakerless ignition system as set forth in claim 2 in which said flange has its geometric center offset laterally a substantial distance from the longitudinal axis of said shank portion toward the adjacent leg portion of said first core.

4. Coil module for a breakerless ignition system as set forth in claim 3 in which said trigger core includes a cylindrical shank portion and a rectangular flange asymmetrically disposed relative to the shank portion, said flange extending at an obtuse angle relative to the axis of said shank portion whereby said flange is disposed in closer proximity to said rotatable magnet means.

5. Method of fabricating a coil module comprising the steps of inserting within a unitary cup-shaped housing an ignition coil and a trigger coil having its axis offset from the axis of the ignition coil, encapsulating said coils within said housing with a potting compound, and fitting the shank portion of a core pin within the axis of said trigger coil, said core pin including an enlarged pole portion disposed externally of said housing.

6. Method of fabricating a coil module as set forth in claim 5 in which the coils are encapsulated within said housing and a hole is thereafter provided through said housing in alignment with the axis of said trigger coil and said shank portion of the core pin is then fitted into said trigger coil until said enlarged pole portion abuts the outer surface of said housing.

7. Method of fabricating a coil module as set forth in claim 5 in which the shank of the core pin is fitted into the axis of said trigger coil before encapsulating said coils within said housing until said enlarged pole portion abuts the outer surface of said housing.

8. Method of fabricating a coil module as set forth in claim 5 in which a voltage is generated in said trigger coil in response to magnet means rotatable relative to the core pin, said core pin includes a cylindrical shank portion and a rectangular pole piece disposed externally of the coil housing, said pole piece being asymmetrically relative to the axis of said shank portion, said pole piece extending outwardly of said shank at an obtuse angle whereby said pole piece is disposed in closer proximity to said rotating magnet means.

* * * * *